US005084077A

United States Patent [19]

Junker et al.

[11] Patent Number: 5,084,077

[45] Date of Patent: Jan. 28, 1992

[54] APPARATUS FOR GAS PURIFICATION

[75] Inventors: Erwin Junker, Nordrach; Klaus Dold, Steinach, both of Fed. Rep. of Germany

[73] Assignee: LTV Lufttechnik GmbH, Achern, Fed. Rep. of Germany

[21] Appl. No.: 613,134

[22] Filed: Nov. 13, 1990

[30] Foreign Application Priority Data

Dec. 21, 1989 [DE] Fed. Rep. of Germany ..... 3942134

[51] Int. Cl.[5] ..... B03C 3/00

[52] U.S. Cl. ..... 55/113; 55/121; 55/138; 55/139; 55/149; 55/120

[58] Field of Search ..... 55/113, 114, 145, 149, 55/121, 138, 139, 120

[56] References Cited

U.S. PATENT DOCUMENTS

| | | | |
|---|---|---|---|
| 1,394,771 | 10/1921 | Kennard | 55/114 |
| 2,663,380 | 12/1953 | Savitz | 183/7 |
| 3,877,897 | 4/1975 | Glucksman | 55/114 |
| 3,929,436 | 12/1975 | Kim et al. | 55/149 |
| 4,000,994 | 1/1977 | Youhouse | 55/149 |

FOREIGN PATENT DOCUMENTS

| | | |
|---|---|---|
| 446008 | 6/1927 | Fed. Rep. of Germany . |
| 457631 | 3/1928 | Fed. Rep. of Germany . |
| 1757115 | 12/1971 | Fed. Rep. of Germany . |
| 2734133 | 4/1978 | Fed. Rep. of Germany . |
| 403722 | 12/1965 | Switzerland . |
| 987220 | 3/1965 | United Kingdom . |

*Primary Examiner*—Bernard Nozick
*Attorney, Agent, or Firm*—Edwin D. Schindler

[57] ABSTRACT

An apparatus for gas purification is provided by means of charge build-up in an ionization means and subsequent electrostatic separation of ionized dirt particles in a separation means, which comprises collection surfaces arranged along lanes which are passed by the gas flow. These lanes are formed between fixed voltage-carrying plates and rotatable, grounded discs. The plates and the discs have substantially the same spacing to one another where a substantially stationary cleaning means strips off the deposited dirt particles on the discs. The arrangement provides an operation essentially independent of the contaminant or pollutant, high efficiency and uncomplicated production.

18 Claims, 10 Drawing Sheets

APPARATUS FOR GAS PURIFICATION

The invention relates to an apparatus for gas purification by means of charging dirt particles in an ionization means, which comprises at least one ionizing electrode, and subsequent electrostatic separation of the ionized dirt particles in a separation means, which comprises lanes of uniform width formed between fixed voltage-carrying plates and grounded discs of various diameter, said discs being rotatable on a rotory shaft and by which the discs as collector surfaces can be cleaned from deposited dirt particles by a stationary cleaning means. As used herein, dirt particles refers to undesired particulate matter in general, for example, dust particles, oil droplets, contaminants, pollutants and the like.

Gas purification apparatus are known which operate according to the principle of ionization through charge build-up and electrostatic separation with the alternative of cleaning a collector.

The efficiency of electrostatic gas purification equipment is determined by a number of electrical and mechanical parameters. In designing the equipment and making adjustment to the operational conditions, most of these parameters are set or restricted to relatively narrow limits. The factors which change considerably depending on the operation of such equipment are the electrical resistance properties of the negative ionization and collector surfaces, which vary due to deposited dirt particles. The controlled compensation of these variations by adjustment of electrical parameters is very difficult.

In addition, this would not account for the influence of deposits on the flow conditions. Another countermeasure would be cleaning off the deposited dirt particles. If this were done in a manner such that the deposits would not appreciably influence the resistance properties, then electrostatic gas purification equipment could be continually operated relatively close to the optimal design set points with very high efficiency.

The removal of the deposited dirt particles causes particular difficulties. This is often done by blowing and/or knocking off the particles which leads to vibrations and noise. In addition, the deposited dust is stirred up, so that some parts of the gas flow to be cleaned must be interrupted.

Electrostatic gas purification apparatus are known in the art having collector surfaces rotating in the gas flow direction, which operate in one stage, i.e. in which the ionization of the dirt particles takes place within the lanes between the discs. The German Patent, DE-PS 446 008, discloses an apparatus in which the insulators are located in the gas stream, the disc surfaces only partially act as collector surfaces and the cleaning of the discs takes place in the gas stream. The cleaning of the electrodes is also performed in the gas stream in the single-stage apparatus known from the British Patent GB 987 220 and the corresponding Swiss Patent 403 722. U.S. Pat. No. 3,929,436 discloses a single-stage apparatus in which the rod or cage-shaped ionization electrodes project radially into the disc lanes and, in another embodiment, a gas purification apparatus with a prior ionization stage, however without a voltage-carrying retarding means in the separation stage. In both embodiments, the cleaning means is arranged between shielding plates mounted transversely to the gas flow, so that the gas stream can only flow through the lanes formed between the discs in the upper section. The same arrangement with respect to the flow through the lanes and the lack of a retarder in the cleaning region is also described for the apparatus of U.S. Pat. No. 4,000,994. The electro-aerodynamic separation means known from the German laid-open document DE-OS 17 57 115 also comprises no voltage-carrying electrodes for retarding the ionized particle in the separation region. In addition, the plates serving as collector electrodes, which are arranged radially with respect to the rotational axis, rotate transversely to the main gas flow direction.

A gas purification apparatus of the present type is known from U.S. Pat. No. 2,663,380 where only about ½ of the disc surfaces act as separation surfaces, while approximately the other half lies in the region of the cleaning means. Even in operation without a liquid cleaning agent, the lower half of the discs does not lie in the gas stream since partial gas flows are prevented by the plates 48 from entering into the lower portion of the housing, which is also the reason that the plates 27 are arranged only in the upper region between the discs 22 and 22a. The insulators of the ionization means and those between the discs and plates in the region of the rotary shaft, through which the air gap insulation between the discs and plates is interrupted in operation, are directly exposed to the loaded gas stream, so that the danger of dirt accumulation and therefore electrical discharge arises, particularly in the region of the rotary shaft. The ionization and separation means operate at the same voltage potential (the same voltage supply) and are insulated with respect to ground. The ionization voltage is therefore limited to the potential allowable for the separation means, which is already relatively limited in the design stage by geometric and insulation requirements and is greatly reduced further in operation by contamination. Even non-conducting cleaning fluids become conductive by dirt particles. The liquid carried by the discs runs onto the insulators between the discs and plates and makes them ineffective.

The object of the present invention is to provide a gas purification apparatus of the mentioned type which

- is optimized with respect to flow properties,
- is efficient in particular with respect to the individual adjustability of the ionization voltage and the utilization of the surface available for collection,
- is insulated so that no dirt particles can be deposited or is insensitive to deposits of dirt particles,
- is suited for mobile use,
- can be flexibly adjusted to various use conditions,
- is easy to service, and
- can be produced and operated with high precision, without the need of special construction and fabrication requirements.

In accordance with the present invention, a gas purification apparatus is provided in which the plates are insulated from the discs by an air gap, the plates comprise open sections in the flow shadow behind the rotor shaft in which the cleaning means is arranged, substantially the entire disc surfaces in the region of the lanes are collector surfaces, the ionization and separation means each have a separate voltage supply, the ionization means is insulated with respect to the separation means and the insulators are arranged outside of the direct gas stream.

An arrangement is known from the German Patent DE-PS 457 631, in which the insulators for voltage supply to electric gas purifiers, not described in more detail, are provided in special spaces next to the precipitation chamber. In the German laid-open document DE-OS 27 34 133, a separate voltage supply for two ionization stages and the separation means is described for a three-stage gas purification according to the principle of post-ionization for neutralizing the non-separated particles, where in a preferred embodiment, the separation means are described as plates.

According to the present invention the plates comprise an open section behind the rotor in flow direction which makes possible the arrangement of the cleaning means therein. Therefore, only the regions of the installed disc surfaces which lie in the flow shadow of the shaft are lost as separation means, which leads to a high utilization.

The function of cleaning means is to clean the rotary collector discs after each rotation in order to eliminate the influence of the deposited dirt on the electrical resistance properties of the collectors and on the flow condition.

Advantages for manufacture and for operation are that the discs are arranged at a distance from one another on the shaft by means of spacers and both the discs and the plates are exactly run in guides or grooves at their outer periphery so that high precision is achievable with the simplest means.

Further advantages result in that the spacings between the voltage-carrying and grounded elements of the apparatus can be variably adjusted depending on the ionization potential without influencing the lane widths due to the arrangement of a varying number of small intermediate-sized discs and the design of the difference in the diameter of the discs. The possibility of using thin wires as the ionization electrode and the multiple mounting of the wires have a positive influence on the corona discharge and on the ionization efficiency, also on the adjustability of the ionization potential independent of the separation voltage. The strict air-gap insulation in the gas passage region, particularly between the discs and plates, and the arrangement of insulators outside of the direct gas stream ensures a reliable insensitivity of the voltage-carrying elements against dirt contamination, which is enhanced by the insulation of the ionization means from the voltage of the separation means. The efficiency of separation is favorably affected by guiding the gas stream with guide plates and the other elements in the gas stream which only slightly influence a laminar gas flow. Advantages in pre-fabrication, assembly, maintenance and flexibility result from the fact that the gas purification apparatus with ionization and separation means as well as cleaning means is completely mounted in one frame, which can be slid into a housing and that all devices required for operation of the gas purification apparatus are provided in the housing such as power supply, rotor drive, pre-filter, guide plates, fan and dirt collection means and that each housing is configured so that several purification apparatus, each with a housing, can be connected to one another in series.

An uncomplicated removal of the separated dust particles is expediently provided in that they are received in an inclined channel and fall into a collection channel due to the slope. In addition, from there the particles are conveyed to a collection vessel.

The formation of ozone is minimized by using positive high voltage. In addition, the invention makes it possible in a simple manner to adjust to varying degrees of gas contamination with solid and/or liquid particles by regulating the rotational speed and/or by connecting one apparatus after another. A mobile use is also possible for dry or partially wet operation due to the simplicity of disposal, for example for purifying exhaust gases from diesel motors.

The invention is described more fully in the following based on an embodiment in conjunction with the attached drawing.

FIG. 1 shows a side cross-section of a purification apparatus along the line V—V of FIG. 7.

FIG. 2 shows a side cross-section of the purification apparatus of FIG. 1, taken from behind rotor 1 of FIG. 1 and showing plates 4 with cut-out open section 5.

Figure 1:
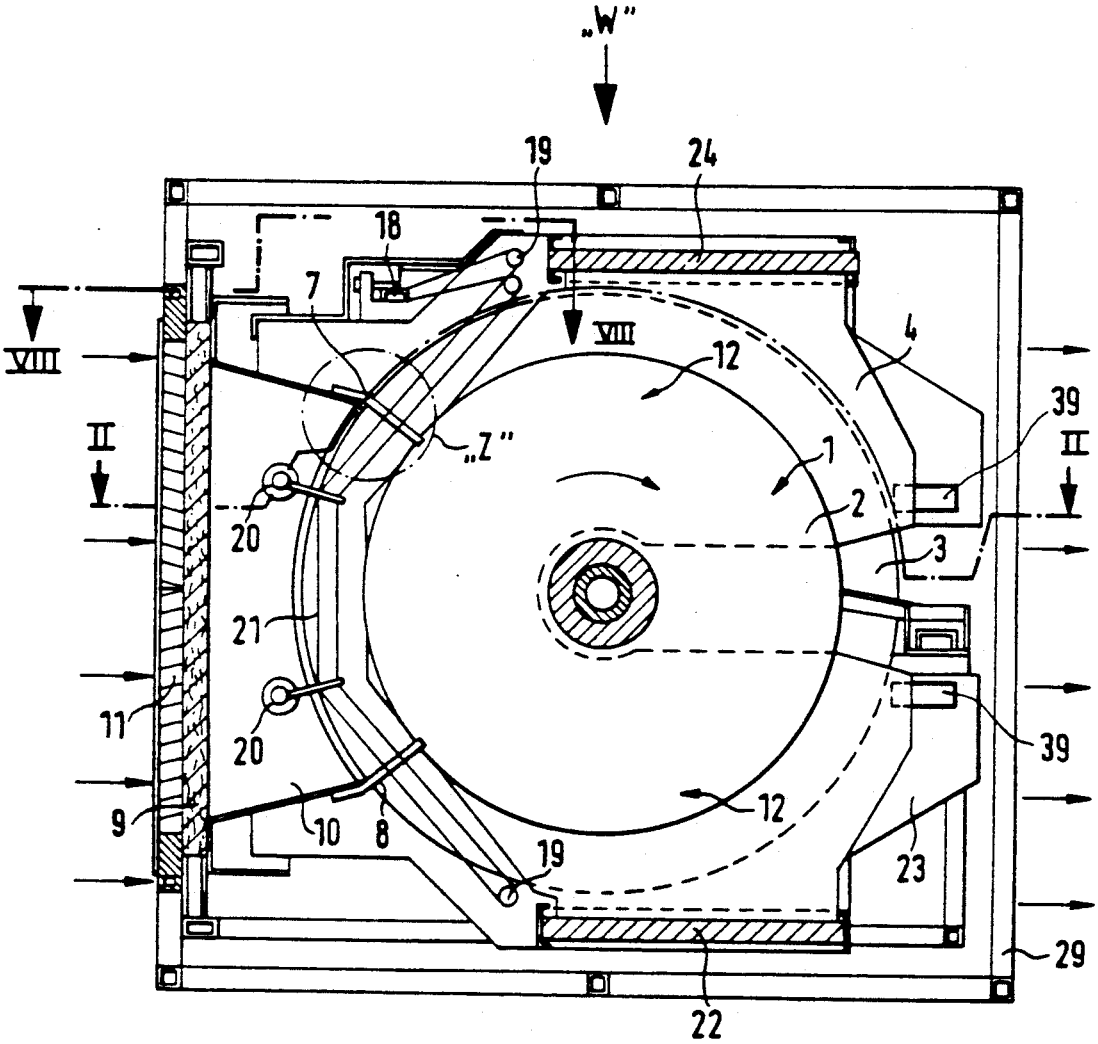
Figure 10:
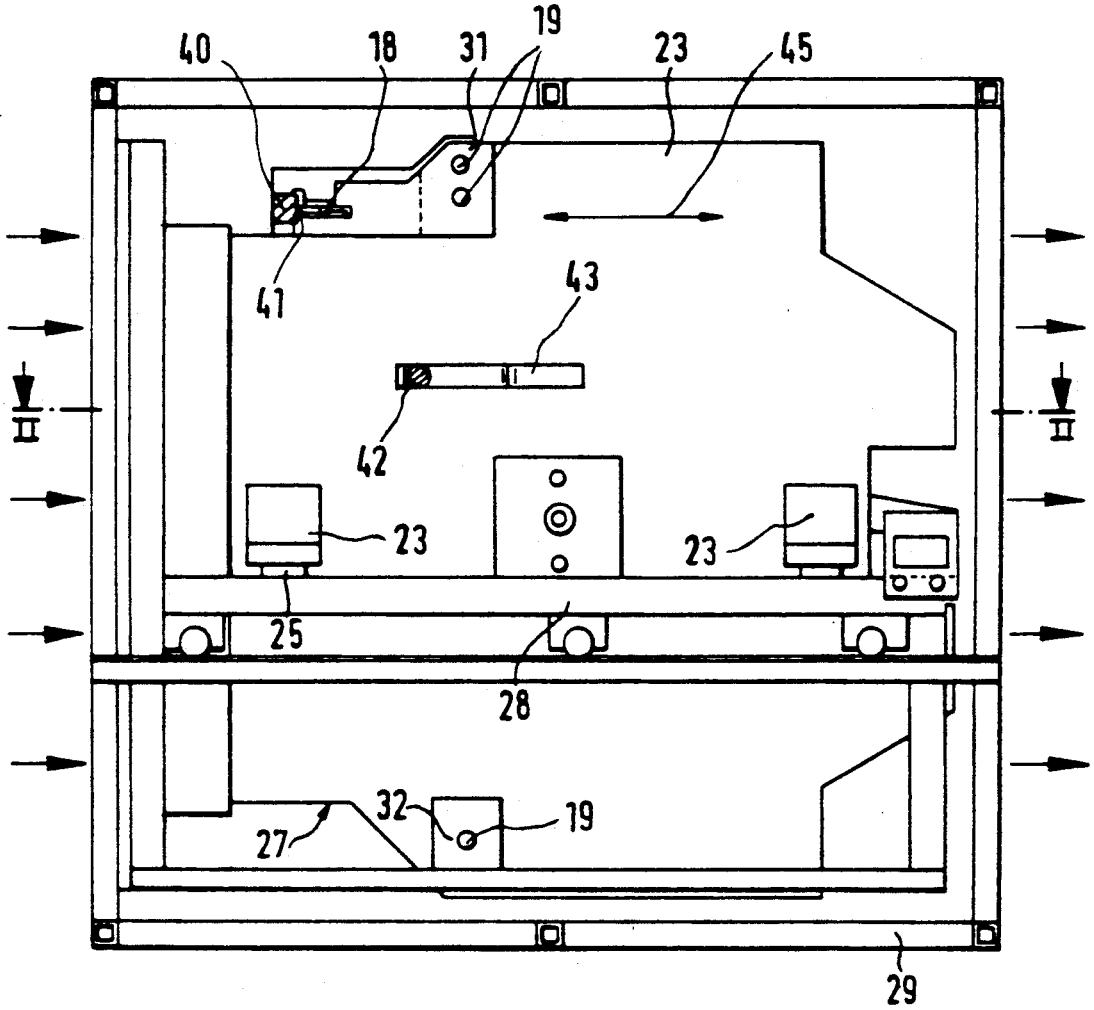
FIG. 10 shows a side view of a purification apparatus along the line VII—VII of FIG. 7.
Figure 13:
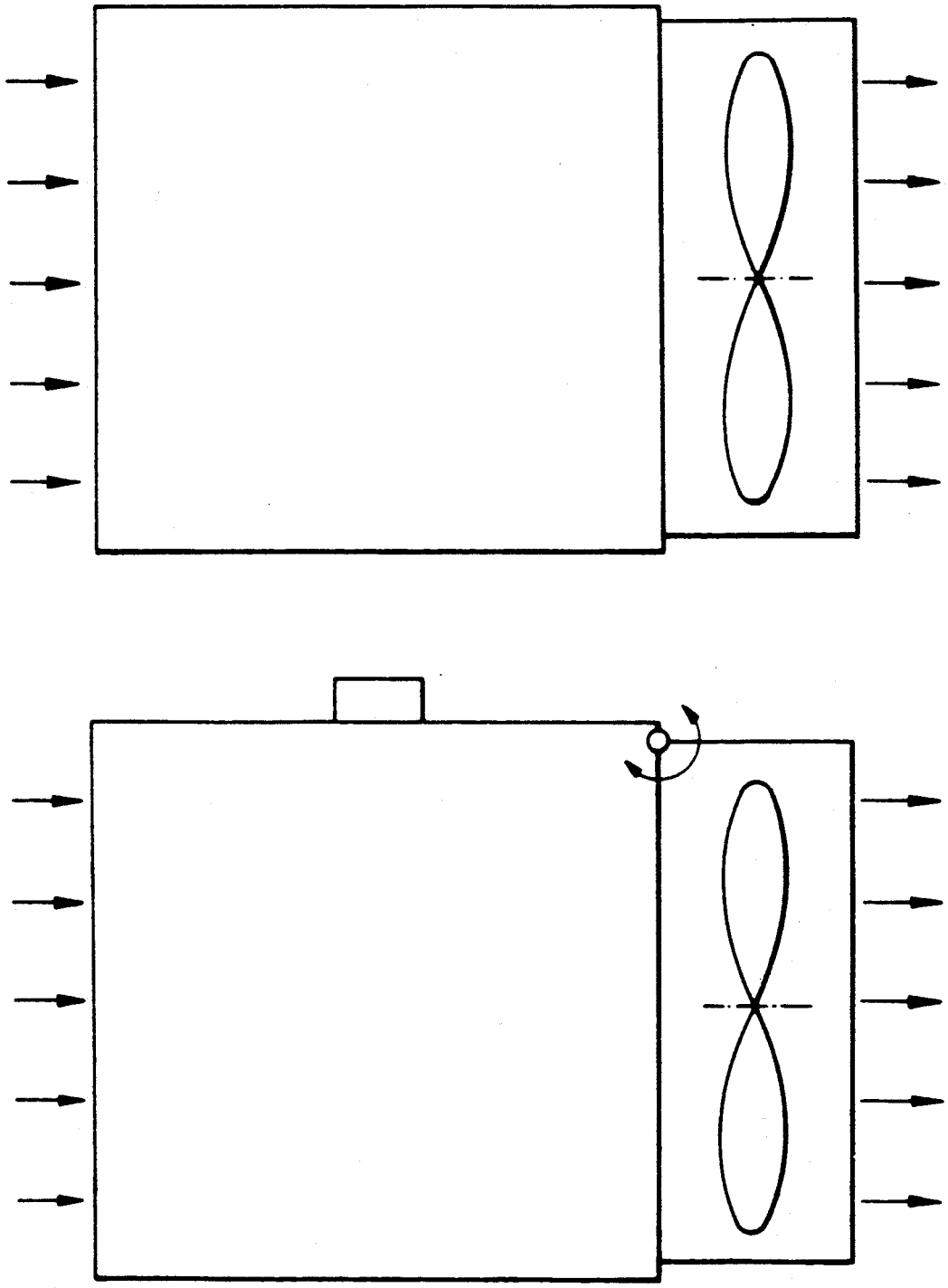
FIG. 13 shows a front view and a plan view of a housing with axial fan.
Figure 14:
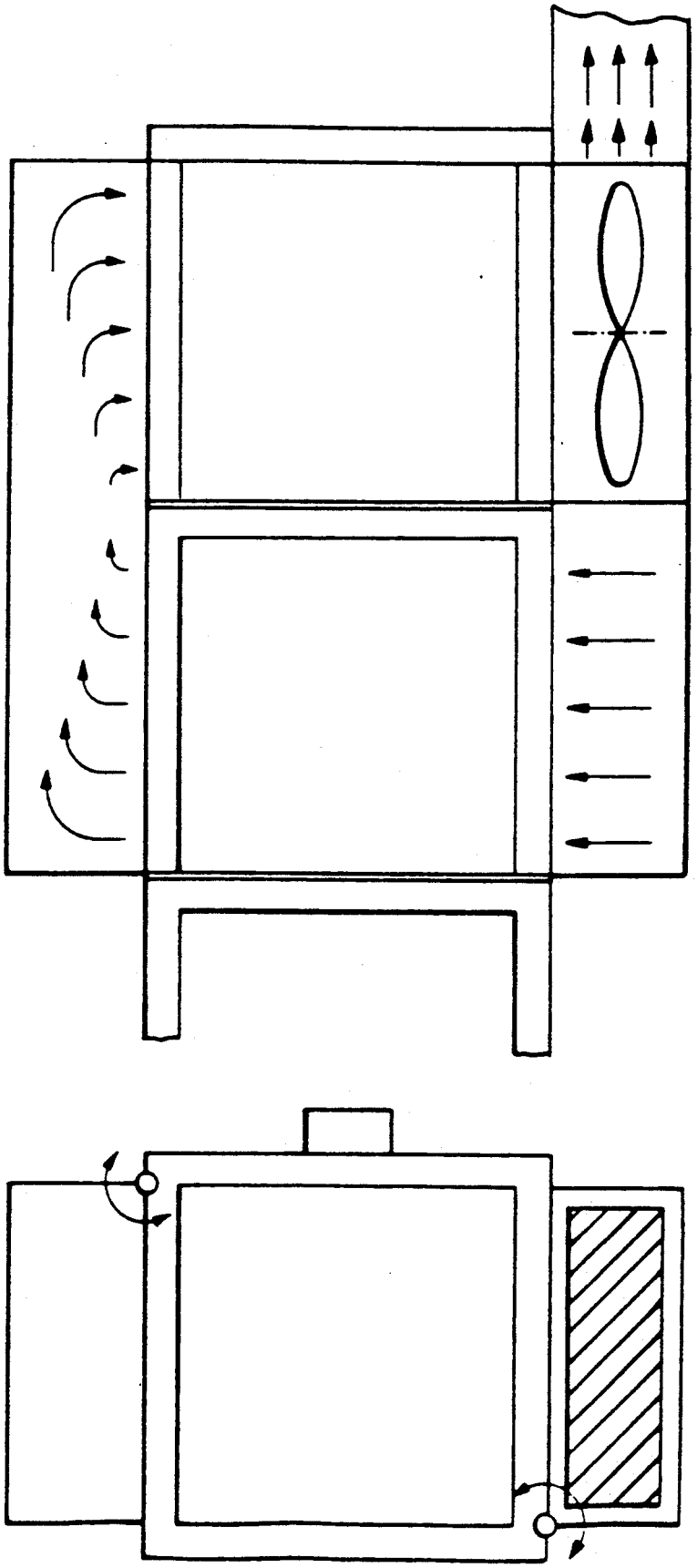
FIG. 14 shows a front view and a plan view of an embodiment in series connection with a radial fan.

FIG. 1 shows a gas purification apparatus with a housing 29 and indicates the direction of gas flow with arrows. Guide plates 11 and a pre-filter 9 are mounted in the housing. The fan mounted on the gas exit side of the housing, as seen in FIGS. 13 and 14, is not shown in FIG. 1. The complete gas purification apparatus is mounted on a frame 28 and slid into the housing as is shown in FIG. 10. After entry into the apparatus, the gas flows through lanes, which are formed respectively between plates and small discs 2 or large discs 3. The discs 2 and 3 can also be formed as polygonal, rotary plates.

Figure 2:
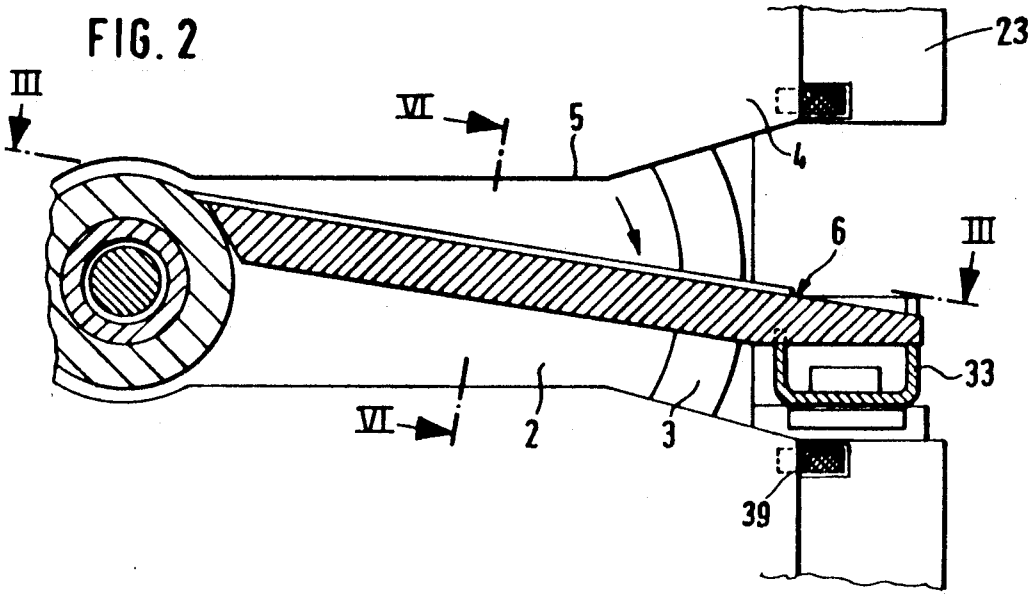

The gas passes in sequence first through the ionization means formed between the projecting surface regions of the large discs 3 and then the separation means or the collector section which is located between plates 4 and the large discs 3 or respectively the small discs 2. The plates 4 have a cut-out open section 5 located in the flow shadow behind the rotor 1 as seen in FIG. 2. A cleaning means 6 is arranged in the region of this open section between two discs, which is fixed or in one embodiment oscillates in the open region of the plates.

The gas is deflected by the guide plate 10 so that it substantially does not flow through the edge regions 12, which lie on the outer periphery of the small discs 2, but passes the separation surfaces over a sufficiently long path. The plates 4 are held in the grooves of the side plates 22 and 24 and the guide beam 39. A wire 21 serves as the ionization electrode which is connected to high-voltage on a wire-holding rack 18 and which runs from there over deflection means 19 and wire guides 20 back and forth in the space which is formed between the side surface portions of the large discs 3 which project beyond the small discs 2 at the beginning in flow direction. The configuration of this space is seen in more detail in FIGS. 5 and 6. The cleaning means 6 and a collection channel 33 are shown in FIG. 2.

The cleaning means 6 is arranged in the region of the open section 5, which is provided in the flow shadow in the plates 4. On one side, it rests slidably on the rotary shaft or spacers 13 on the shaft and on the other side, it is fixed to the collection channel 33, so that it is inclined downwardly in the direction of flow. The region of the cleaning means is substantially not passed by the gases since the gas is deflected by the rotor 1.

In other embodiments, for example for a vertical gas flow, the cleaning means 6 can be arranged in flow direction or positively or negatively inclined to the flow direction. In such cases, at least a portion of the removed substances can fall into the collection channel 33.

Figure 3:
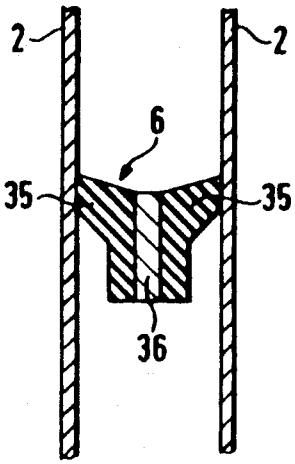
FIG. 3 shows a cross-section along the line VI—VI of FIG. 2.

The cleaning means 6 comprises a support 36 which for example can be made of metal. Stripper lips 35 of a flexible material, for example rubber, are arranged on either side of the support 36, so that they contact the side surfaces of the two small discs 2 as shown in FIG. 3 or the side surfaces of the small disc 2 and the large disc 3. In this manner, the deposits of solid particles or liquid droplets adhering to the discs, acting as the collector electrode, are stripped off. The deposits land in the channel formed by the stripper lips 35 and are conveyed in the direction of the collection channel 33 by the decreasing slope of the cleaning means 6. The dirt or contaminants are transported from the collection channel 33 into a collection vessel included in the housing.

Figure 11:
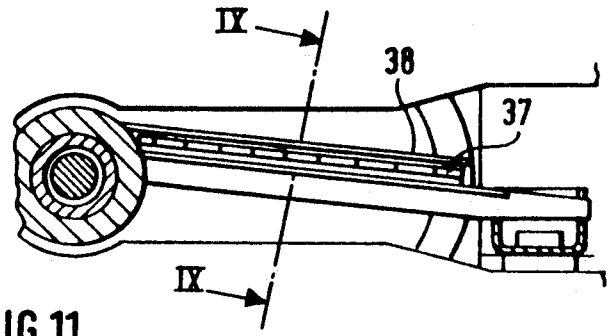
FIG. 11 shows a side view of an alternative embodiment of the cleaning means to that which is illustrated in FIGS. 1 and 2.
Figure 12:
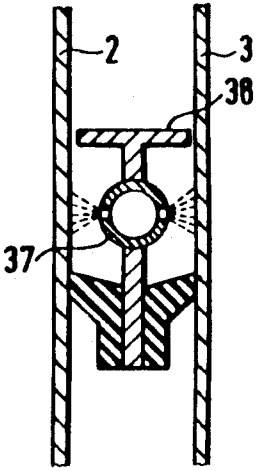
FIG. 12 shows a cross-section of the alternative embodiment of the cleaning means of FIG. 11, taken along the IX—IX line of FIG. 11.
Figure 4:
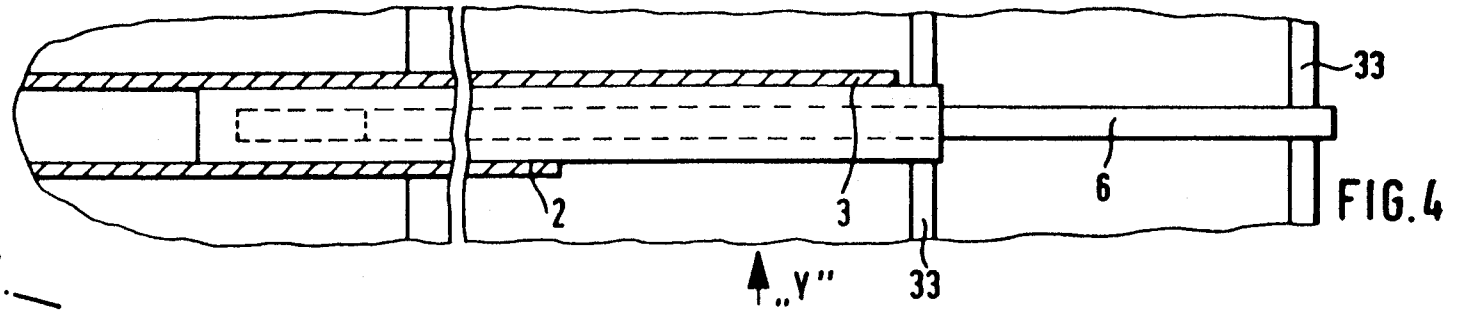
FIG. 4 shows a plan view of the purification apparatus of FIG. 1, taken along the III—III line of FIG. 2.

A further embodiment of the cleaning means is shown in FIGS. 11 and 12. The support or carrier is enlarged in the rotational direction and supports a wash nozzle 37 and above it, a T-shaped protection plate 38. This embodiment has the advantage that non-flowable contaminants can be wetted and are therefore better transportable as a slurry. The protection plate 38, which can also be provided without the wash nozzle, provides an additional protection against the flowing gases, so that the striped-off dirt cannot be picked up again. In the arrangement with a wash nozzle, protection is provided against a mixing of the liquid droplets with the purified gas stream. The plan view in FIG. 4 illustrates the arrangement of the cleaning means.

Figure 5:
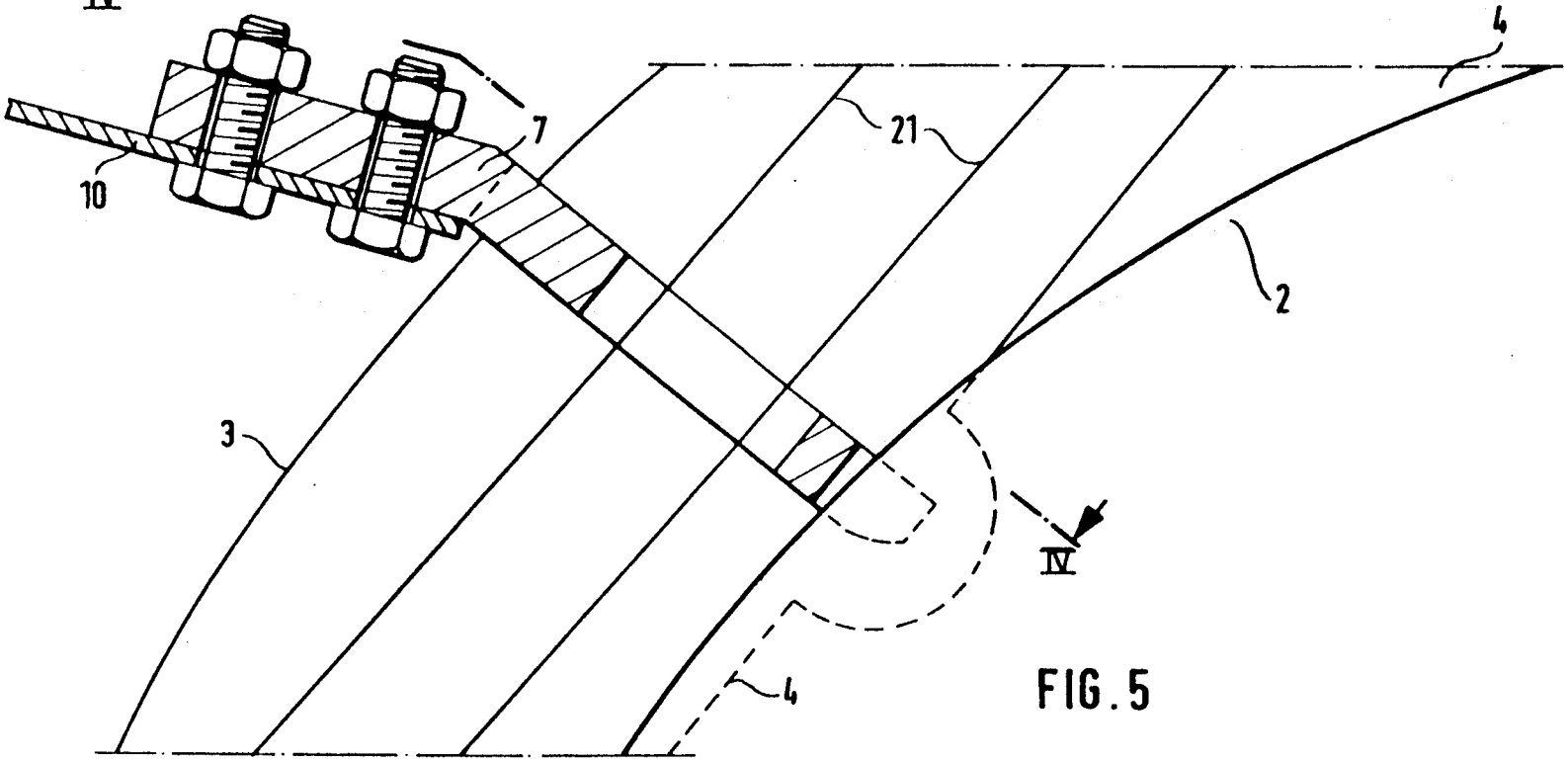
FIG. 5 shows the portion Z of FIG. 1 where the details are given in enlarged scale.
Figure 6:
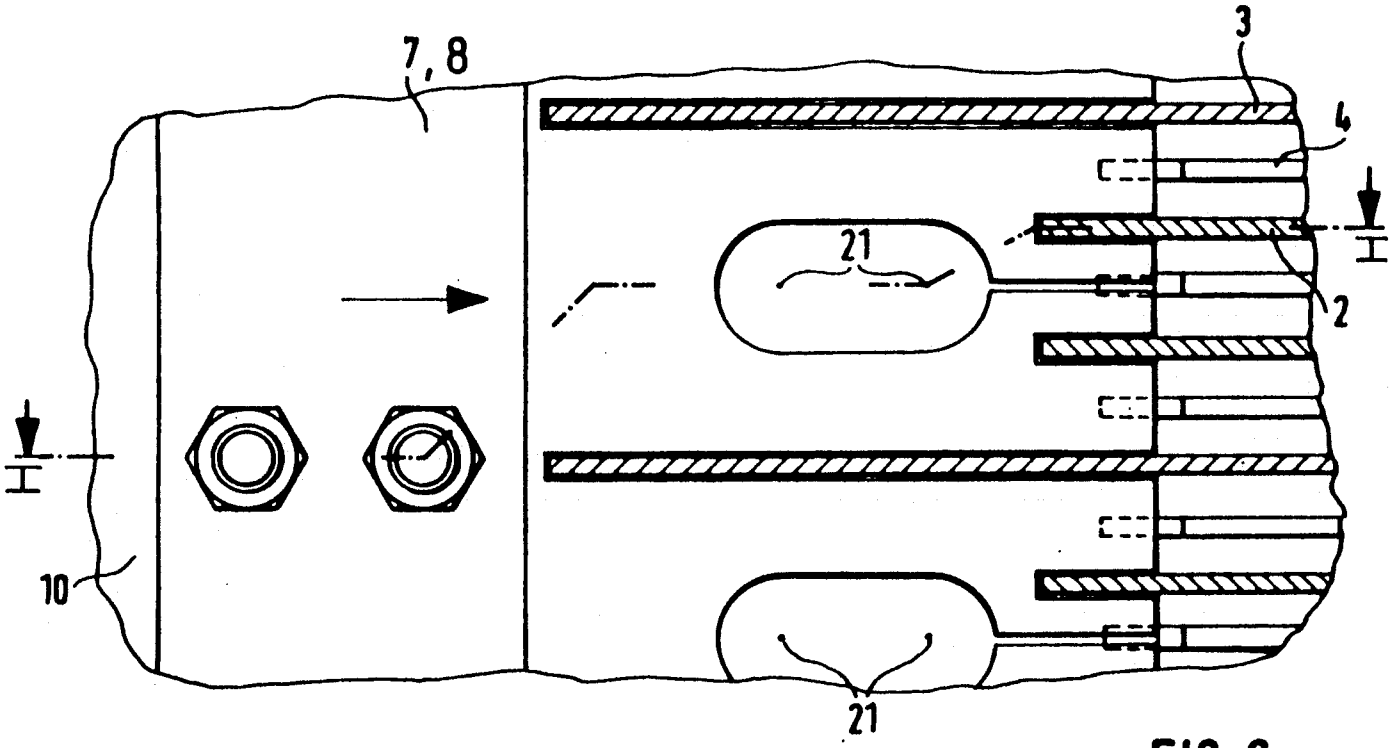
FIG. 6 shows a plan view of FIG. 5 along the line.

FIGS. 5 and 6 show a detail of the space in which the ionization means is arranged and the construction of the disc guides 7 and 8. These disc guides comprise slits in which the large discs 3 and the small discs 2 are run with very little tolerance. In addition, a slit which extends into an oval is provided so that the disc guides can be shifted past the spanned ionizing wires 21. The charged plates 4 have recesses, as shown in FIG. 5, so that they do not contact the disc guides. Due to this exact disc mounting as well as the mentioned grooves for the plates 4 in the side plates 22 and 24 as well as the guide beams 39 and the arrangement with spacers on the rotary shaft, it is possible to produce the discs 2 and 3 as well as the plates 4 with relatively little effort having an tolerance of $\pm 0.5$ mm and despite this, to maintain a very exact geometry of the lanes. The end of the disc guides 7 or 8 are rounded for reasons of stream-lining the flow.

Figure 7:
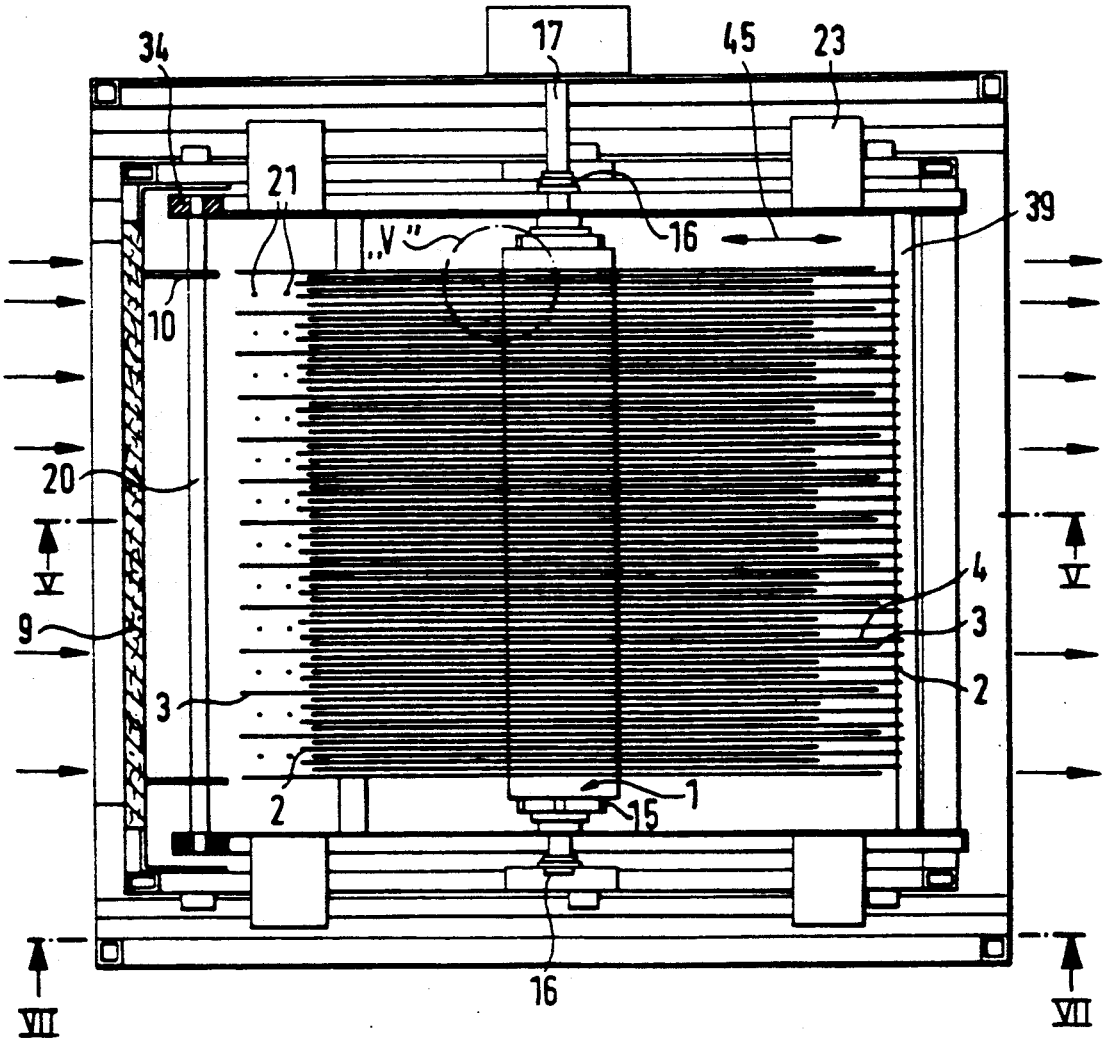
FIG. 7 shows a sectional plan view of the purification apparatus along the line II—II of FIG. 1, where the cleaning means is not shown.

FIG. 7 illustrates the arrangement of the lanes and the spaces for the ionization means arranged at the beginning in flow direction between the large discs 3. An insulating body 34 is also provided there outside of the direct gas flow. The structural relationship between the large discs 3 and the cleaning means 6 and the collection channel 33 is best shown in FIG. 1; the cleaning means 6 and collection channel 33 not being shown in FIG. 7.

Figure 8:
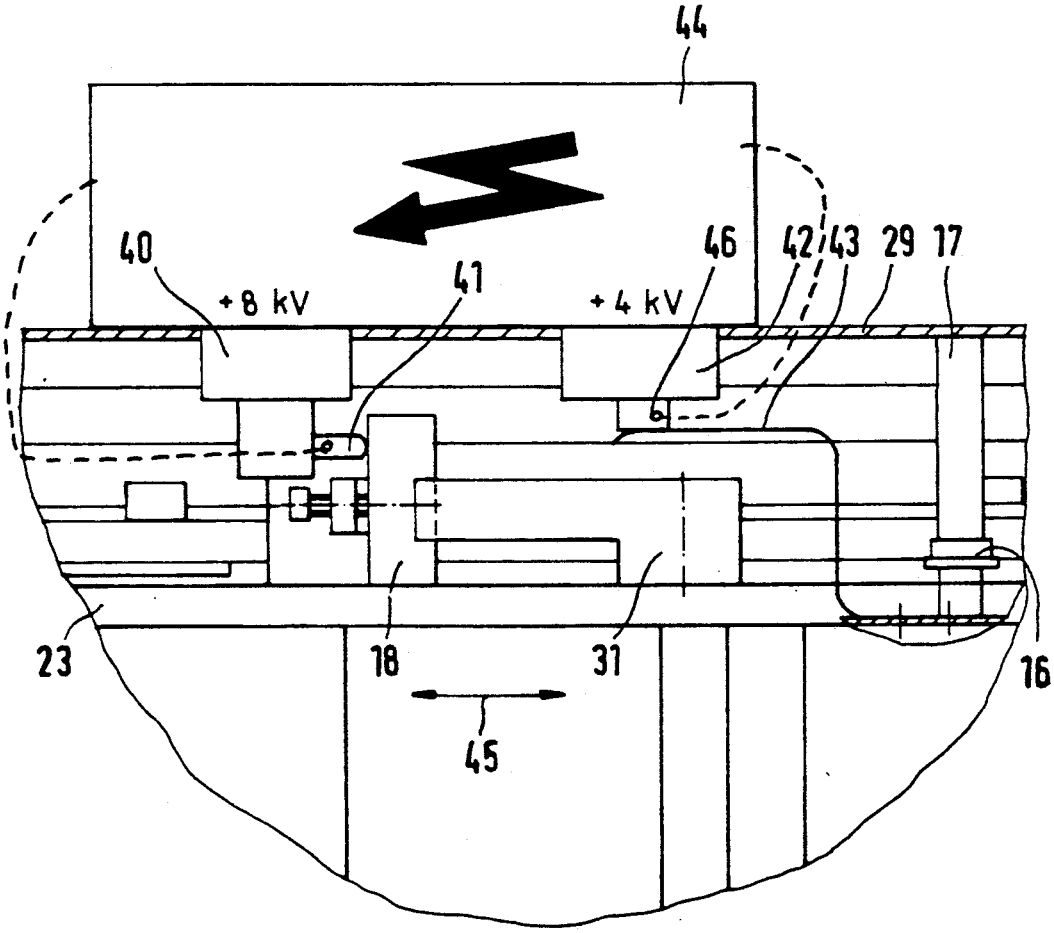
FIG. 8 shows a partial sectional plan view corresponding to the line VIII—VIII of FIG. 1.

FIG. 8 illustrates the voltage supply for the ionization means and for the separation means. The voltage is supplied from switching cabinet 44 for the ionization means via a contact 41 which is insulated with respect to the housing 29 by the insulator 40. The supply for the separation means is made by the contact 46 which is insulated with respect to the housing 29 by the insulator 42. The contact 41 is spring-loaded and ensures the voltage supply to the wire-holding rack 18. A contact spring 43 ensures the connection of a frame 23 and through it to the plates 4. Both power supply means are so configured that when sliding in the frame 28 into the housing 29 in the direction of the arrow 45 with the completely mounted cleaning means, the electrical connection is completed. In the illustrated embodiment, the ionizing voltage of 8 kV is twice as high as the separation or collection voltage of 4 kV so that the insulation potential corresponding to the voltage difference is only 4 kV. Therefore, this solution provides a simplification of the electrical relationships and avoids the influences of contamination.

Figure 9:
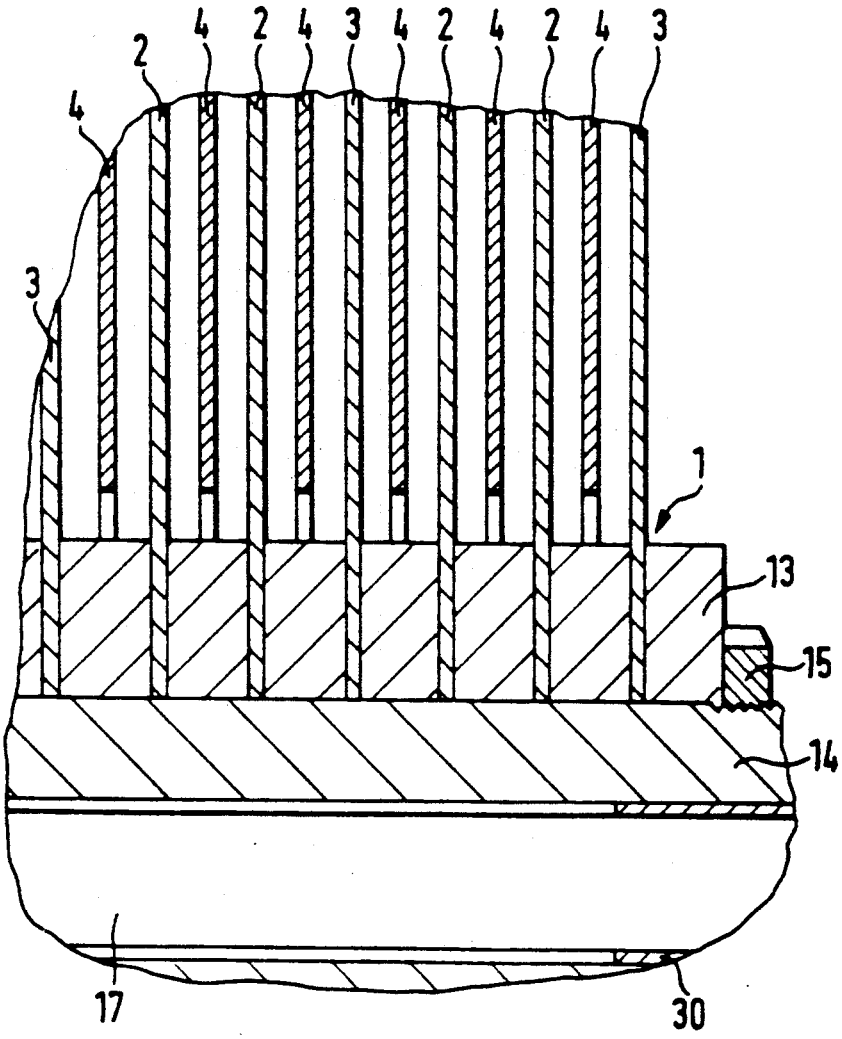
FIG. 9 shows the portion V of FIG. 7, where the details are given in enlarged scale.

The rotor 1 with the rotary shaft 17 is mounted in the bearings 16 and is driven, for example, electrically. FIG. 9 shows the structure of the rotor 1. A hollow shaft 14 sits on the rotary shaft 17 on a bearing sleeve 30. The discs 2 and 3 are mounted on the hollow shaft and spaced apart from one another by distance spacers 13. The arrangement is secured with a nut 16. The plates 4 which are cut out around the rotary shaft, are located respectively between the discs 2 and 3 and with them form the lanes through which the gas to be cleansed flows. This type of shaft construction offers particular advantages in construction and fabrication. In FIG. 10 it can be seen that the entire purification apparatus 27 with ionization and collection means as well as cleaning means is mounted on the frame 28 and can be slid into the housing 29 as a whole. In addition, insulators 25, 31 and 32 as well as the wire-holding rack 18 are arranged on the frame 23. The polluted gas stream containing dirt particles is pre-cleaned after entry into the housing by the pre-filter 9 and converged by the guide plate 10, so that the gas only passes the region in which the collector plates have sufficient length to allow deposits to be made. Subsequently, the gas exits from the apparatus through the fan. During flow the gas first passes the ionization means in which the dirt particles are charged by the spray effect of the corona discharge of the ionizing electrodes. The separation means follow in flow direction, where the charged dirt particles are deflected by the positive voltage on the plates 4 onto the discs 2 and 3 acting as the deposit or collection electrodes. The discs transport the deposited dirt particles to the cleaning means 6 arranged in the flow shadow of the rotar shaft so that for each revolution each surface area of the discs is driven once past the cleaning means and the dirt particles adhering thereto are stripped off. In the area of the cleaning means 6, the danger of an electrical spark discharge is avoided by the open section 5 of the plates 4. In this embodiment it is possible to perform the cleaning continuously during operation, i.e. under maintenance of the gas flow and the voltage both in the ionization and collector region. Short interruptions are possible, however, not necessary for the process. The pre-filter 9 arranged on the housing and the guide plates 11 provide an equilibration of the gas stream before entry into the apparatus. By converging the gas flow with the guide plates 10 it is achieved that the gas stream does not pass through the edge zones 12 of the lanes, where the path through the lanes would be insufficiently long. The danger would exist that an effective collector path would not be maintained, which, for example, must be at least 150 mm for a lane spacing of 6 mm and a plate voltage of 5 kV at a flow velocity of 3 m/sec.

Use of an axial blower is shown in FIG. 13, while a radial blower is shown in FIG. 14. It is generally known to those skilled in the art that an axial blower is used when an air cleaner blows the exhaust air back into the room being used. In general, the capacity of axial blowers is lower than when a radial blower is used, as is shown in FIG. 14. Radial blowers are generally used in the relevant technical art with equipment having higher capacities, which exhaust via a shaft or duct, e.g., into the open air. As shown in the drawing figures, both types of blowers may be used with the present invention.

The design of this embodiment guarantees the necessary precision of the lane geometry without any particular effort in fabrication due to the exact guidance of the plates and discs.

We claim:

1. Apparatus for the purification of a gas by charging dirt particles, comprising:

means for guiding a flow of a gas;

ionization means having at least one ionizing electrode for carrying out an ionization of dirt particles;

separation means for carrying out an electrostatic separation of the ionized dirt particles with said separation means and said ionization means having separate voltage supplies, said ionization means being insulated with respect to the voltage supply of said separation means, said separation means including:

a rotary shaft;

cleaning means;

fixed voltage-carrying plates which are arranged to form lanes of uniform width, said fixed voltage-carrying plates having open sections in a flow shadow behind said rotary shaft, in which said cleaning means are arranged; and, grounded discs of varying diameters, said discs being rotatable on said rotary shaft, with surfaces of said grounded discs, in the region of said uniform lanes, acting as collector-surfaces, except for regions opposing the open section of said fixed voltage-carrying plates, which are capable of being cleaned of deposited dirt particles by said cleaning means, said fixed voltage-carrying plates being insulated from said grounded discs by an air gap; and, a plurality of insulators for said ionization means and said separation means, said plurality of insulators being arranged outside of the direct flow of gas.

2. The apparatus according to claim 1, wherein said grounded discs include discs of two sizes designated as large discs and small discs.

3. The apparatus according to claim 2, wherein said means for guiding a flow of the gas includes guide plates which are arranged so that the flow of the gas is not substantially through edge regions of said lanes to a side of the flow direction between said fixed voltage-carrying plates and said small discs of said grounded discs.

4. The apparatus according to claim 2, wherein said rotary shaft supports a hollow shaft, in which at least one of said small discs is arranged between two of said large discs and that the space so formed in front of said lanes in the flow direction of the gas accepts said ionization means, the space also being free of said fixed voltage-carrying plates and serving for the placement of said at least one ionizing electrode.

5. The apparatus according to claim 4, wherein said ionizing electrodes are formed of electrically conductive rods.

6. The apparatus according to claim 4, wherein said ionizing electrodes are formed of ionizing wire.

7. The apparatus according to claim 6, wherein at least one of said ionizing wires is arranged in front of at least two of said lanes, respectively.

8. The apparatus according to claim 1, wherein said cleaning means contacts said grounded discs.

9. The apparatus according to claim 8, wherein said cleaning means is movable, said cleaning means oscillating about a stationary position.

10. The apparatus according to claim 8, further comprising a protection plate being arranged in front of said cleaning means in rotational direction, said protection plate having a small spacing from said grounded discs.

11. The apparatus according to claim 8, wherein said cleaning means has a slope with respect to the horizontal and lies in an angular range of $\pm 25°$ with respect to the flow direction of the gas.

12. The apparatus according to claim 8, wherein said cleaning means comprises a support of a rigid material, which rests in sliding contact on a spacer of said rotary shaft and which is fixed at an end to a collection channel, said support having stripper lips of a plastic material attached thereto which contact said grounded discs.

13. The apparatus according to claim 12, wherein said stripper lips are inclined upwardly toward said grounded discs so as to form an additional channel, said cleaning means being inclined downwardly toward said collection channel with said collection channel and said additional channel joining into a single channel.

14. The apparatus according to claim 12, wherein said support is extended in a direction opposite to the rotation of said grounded discs and is provided with a nozzle, which includes apertures directed toward said grounded discs through which a fluid is sprayable onto said grounded discs.

15. The apparatus according to claim 1, wherein said cleaning means comprise nozzle means through which a fluid is capable of being jetted against said grounded discs.

16. The apparatus according to claim 15, wherein said cleaning means is movable, said cleaning means oscillating about a stationary position.

17. The apparatus according to claim 1, wherein said purification apparatus is mounted in a frame which is capable of insertion into a housing.

18. The apparatus according to claim 17, wherein a plurality of said housings, each containing one of said purification apparatus units, are connected to one another in series.

* * * * *